US006736261B1

(12) United States Patent
Thomas et al.

(10) Patent No.: US 6,736,261 B1
(45) Date of Patent: May 18, 2004

(54) SLIDING SHELL PACKAGE FOR SMOKING ARTICLES AND METHOD

(76) Inventors: Timothy Frederick Thomas, 3601 Blairwood St., High Point, NC (US) 27265; Leslie Elizabeth Jarrell, 10609 Coquita La., Tampa, FL (US) 33618; Roland Charriez, 1681 Horton Rd., Mohegan Lake, NY (US) 10457; Thomas Charles VanDyk, 369 Wyckoff Ave., Ramsey, NJ (US) 07446

( * ) Notice: Subject to any disclaimer, the term of this patent is extended or adjusted under 35 U.S.C. 154(b) by 86 days.

(21) Appl. No.: 09/956,533

(22) Filed: Sep. 19, 2001

(51) Int. Cl.[7] ..... B65D 85/10

(52) U.S. Cl. ..... 206/265; 206/267; 206/236; 206/259; 206/807; 206/779; 220/345.2; 220/23.91; 229/87.01

(58) Field of Search ..... 206/265, 266, 206/267, 268, 270, 247, 271, 273, 807, 236, 259, 493, 497, 45.23, 45.25, 775, 776, 767, 779; 220/345.1, 345.2, 345.4, 351, 23.87, 23.91, 810–816; 229/87.12–87.14, 87.01, 160.1, 123

(56) References Cited

U.S. PATENT DOCUMENTS

| | | | | | |
|---|---|---|---|---|---|
| 472,582 | A | * | 4/1892 | Green | 213/84 |
| 926,537 | A | | 6/1909 | Bagley | |
| 927,638 | A | | 7/1909 | Chambers | |
| 941,140 | A | | 11/1909 | Glover | |
| 970,258 | A | | 9/1910 | Nock | |
| 1,341,295 | A | | 5/1920 | Burtis | |
| 1,581,547 | A | | 4/1926 | Rowe | |
| 1,685,765 | A | | 9/1928 | Mangan | |
| 1,797,419 | A | | 3/1931 | Hothersall | |
| 1,860,637 | A | | 5/1932 | Von Meister | |
| 1,946,845 | A | | 2/1934 | Fisher | |
| 2,012,033 | A | | 8/1935 | Atwater et al. | |
| 2,295,747 | A | | 9/1942 | Mills | |
| 2,313,428 | A | | 3/1943 | Glenn | |
| 2,315,900 | A | | 4/1943 | Lupfer | |
| 2,378,774 | A | | 6/1945 | Husted | |
| 2,489,452 | A | | 11/1949 | Davis | |
| 2,867,369 | A | | 1/1959 | Cernera | |
| 3,168,952 | A | * | 2/1965 | Palmer | 206/526 |
| 3,298,504 | A | * | 1/1967 | Carter | 206/777 |
| 3,334,734 | A | * | 8/1967 | Meyers | 206/497 |
| 3,670,881 | A | * | 6/1972 | Dutcher | 229/125.015 |
| 3,765,529 | A | * | 10/1973 | Mueller | 206/779 |
| 3,927,820 | A | * | 12/1975 | Wagner et al. | 220/796 |

(List continued on next page.)

FOREIGN PATENT DOCUMENTS

| | | | | |
|---|---|---|---|---|
| GB | 2212471 A | * | 7/1989 | B65D/65/26 |
| WO | WO 03/002425 | | 1/2003 | |

OTHER PUBLICATIONS

Congdon–Martin, Douglas, "Tobacco Tins: A Collector's Guide," 1992.

Douglas Congdon—Martin, "A Collector's Guide," *Tobacco Tins*, pp. 147, 66.

*Primary Examiner*—Jila M. Mohandesi
(74) *Attorney, Agent, or Firm*—Brinks Hofer Gilson & Lione

(57) ABSTRACT

Smoking articles, such as filter cigarettes, are packaged in a metal box which is curved to a shape that conforms to the curvature of the human body so that the box can be comfortably carried in a shirt or pant pocket. The metal box comprises a lid and a five-sided tray each of which has rolled lips which interengage to mechanically and slidably retain the lid to the tray. The lid covers the open front of the tray and is slidable along an arcuate path corresponding to the radius of curvature of the lid to selectively open or close the front of the tray. The metal box is sealed with a shrinkable band, further packaged in a paperboard box and overwrapped with a polymeric film having a tear tape. The package is unique and attractive and provides several product differentiation features.

24 Claims, 2 Drawing Sheets

U.S. PATENT DOCUMENTS 4,300,675 A 11/1981 Wagner
4,342,403 A 8/1982 Badtke et al.
4,465,184 A 8/1984 Bruce
4,718,553 A * 1/1988 Adamoli et al. ..... 206/459.1
5,131,536 A 7/1992 Wu
5,201,463 A * 4/1993 George ..... 229/203
5,458,256 A 10/1995 Opheim
5,507,429 A * 4/1996 Arlin ..... 229/102
D370,081 S 5/1996 Mauldin
5,590,779 A * 1/1997 Ramsey ..... 206/459.1
5,682,986 A * 11/1997 Cobler ..... 206/265
6,216,861 B1 4/2001 James et al.
6,363,691 B1 4/2002 Flaherty
6,435,342 B1 8/2002 Agnes

* cited by examiner

SLIDING SHELL PACKAGE FOR SMOKING ARTICLES AND METHOD

FIELD OF THE INVENTION

The present invention relates to packages for smoking articles and a method for packaging and unpackaging smoking articles, such as filter cigarettes, and more particularly to a unique and aesthetically pleasing, tamperproof sliding shell package for cigarettes which can be further packaged in a paperboard box overwrapped with a polymeric film having a tear tape.

BACKGROUND OF THE INVENTION

It has been known for many years to package cigarettes and other types of tobacco or smoking article products in thin sheet metal packages or boxes of a size suitable for carrying in a shirt or coat pocket. Such packages have been known as "tobacco tins" or "pocket tins" or "tobacco cans." Typically, such cans or tins have a hinged top lid which is pivoted open to allow access to the can contents, or a sliding top lid which is slid along guides to one side or the other to allow access to the can contents, or a pressed-on top lid that is urged upwardly to remove it from the top of the can. A few examples of such known tobacco cans are disclosed in U.S. Pat. Nos. 1,341,295; 1,797,419; and 1,946,845. It is known that such metal cans or tins are better able to preserve the freshness of cigarettes and other tobacco products contained therein.

In recent years, manufacturers of cigarettes and other tobacco products have packaged cigarettes in paper and paperboard wrappers and boxes and have used foil/paper laminates, metallized paper or plastic wrappers or low permeability transparent or metallized polymeric sheet overwraps, among other types of packaging, to preserve the freshness and aroma of the packaged cigarette and tobacco products. Examples of such packages are disclosed in U.S. Pat. Nos. 4,852,734; 5,139,140; and 5,542,529 assigned to the assignee of the present invention.

Such packaging has become commonplace for most cigarette manufacturers so that, apart from strong brand names and trademarks, product packaging itself has not provided the sort of product differentiation in the marketplace for cigarettes that it has for other consumer products, many of which utilize unique forms of packaging for product differentiation or product origin purposes. It would be desirable, therefore, to provide a cigarette package and a packaging method that would improve product differentiation of cigarettes in the marketplace and still achieve appropriate preservation of the freshness and aroma of the cigarettes.

SUMMARY OF THE INVENTION

The present invention is directed to a novel cigarette package article comprising a curved metal box or tray with a metal lid slidable along an arcuate path for containing a plurality of smoking articles, such as 20 filter cigarettes, in a tamperproof and freshness preserving manner, as well as a method of packaging and unpackaging the smoking articles. Conventionally, a filter cigarette package is in the form of a rectangular parallelepiped having six sides or panels, wherein the "top" of the package is that package side or panel toward which all of the filters of the filter cigarettes are oriented, and the "bottom" of the package is the side or panel opposite the "top." The "front" and "back" of the typical conventional cigarette package are the two sides or panels of the greatest surface area, and the remaining two opposite sides or panels extend between and connect the front and back and the top and bottom. The package of the present invention will be described using the foregoing terms, namely, top and bottom, front and back and opposite sides or panels.

Although the package of the invention may be configured in a number of forms that are not specifically illustrated herein, a preferred embodiment of the invention comprises a five-sided metal box or tray with an open front and a metal front lid that comprises a sixth side or panel of the tray with guides or tracks along two edges. The guides or tracks of the front lid are slidable along complementary guides or tracks on two edges of the metal tray to thereby open and close the open front of the metal tray. The bottom of the metal tray and the metal lid each have a curved or arcuate shape generally in the form of a segment of a cylinder, the radius of curvature of the bottom of the metal tray being somewhat smaller than the radius of curvature of the metal lid. Thus, when the metal lid is slid along the complementary guides relative to the metal tray, it moves along an arcuate path with a radius corresponding substantially to the radius of curvature of the metal lid.

The metal tray and lid are preferably formed of a thin metal, such as 1018 steel alloy or 3003 aluminum alloy, having an as-formed thickness of between about 0.005 to about 0.015 inches. The tray and lid have rounded comers and are preferably shallow drawn cans, but may be formed by other conventional metal working processes. The upper edges of the four upstanding sides of the tray are rolled over to form a smooth rolled lip around the entire periphery of the upper edge of the tray. This rolled lip advantageously eliminates any exposed sharp metal edges that might otherwise cut the consumer and also provides a track for slidably engaging a complementary rolled edge on three edges of the metal lid in substantial metal-to-metal contact. One edge of the lid and short portions of the adjacent lid edges are folded over and flattened to eliminate exposed sharp edges on the lid that could cut the consumer. The flattened portions of the lid preferably contact the rolled lip of the tray so that the lid engages the rolled lip in substantial metal-to-metal engagement around the entire periphery of the open front of the tray. The metal lid and/or metal tray may be embossed for decorative purposes or for providing additional stiffness to the metal tray or lid.

After the metal tray is filled with smoking articles, cigarettes, for example, and the lid is slid over the open front of the tray to close the same, a shrinkable band, preferably a heat-shrinkable polymeric band, is positioned around the engaged edges of the lid and tray and is shrunk, e.g., by application of heat, to urge the edges of the lid and the rolled lip of the tray in substantial sealing contact so as to aid in preserving the freshness and aroma of the cigarettes contained in the tray. The shrinkable band is preferably provided with one or more rows of transverse perforations or a tear strip for assisting in the removal of the band when it is desired to open the box.

The sealed metal cigarette box may be marketed as the final cigarette package, however, according to another aspect of the invention, the sealed metal cigarette box may be, and is preferably, further packaged in a paperboard box or label wrap overwrapped with a polymeric film, such as a transparent polypropylene film or a metallized polyethylene terephthalate film, and is provided with a tear tape for tearing off the overwrap film covering the paperboard box or label wrap. The paperboard box is preferably in the form of a rectangular parallelepiped with the front panel or lid thereof hinged at one side by a fold or crease line in the paperboard box. To enhance the attractiveness of the package when a transparent overwrap film is used, a portion of the lid of the paperboard box may be cut away to expose a portion of the curved metal box, preferably a portion of the metal lid of the box having a design or indicia embossed therein.

If the overwrap is a transparent polymeric film, the paperboard box is preferably printed with product indicia, logos and the like. If the overwrap is a metallized polymeric film, such as, for example, the overwrap film described in U.S. Pat. Nos. 5,427,235, assigned to the assignee of the present invention, the printed product indicia, logos, etc., are preferably printed on the overwrap film and may or may not be duplicated on the paperboard box.

According to the method of the invention, a package comprising a curved metal tray containing a plurality of cigarettes is closed by a curved metal lid which is mechanically and slidably engaged to the metal tray. The metal lid is sealed in substantial metal-to-metal contact to the metal tray with a perforated shrinkable band, then the sealed metal box is packaged in a paperboard box overwrapped with a polymeric film having a tear tape. To open or unpackage the cigarettes in the metal box, the tear tape is used to tear the polymeric film away so that the metal box can be removed from the paperboard box. The shrinkable band is then ruptured along the perforations in the band and removed and the metal lid is slid along an arcuate path to open the front of the metal box and expose the cigarettes contained therein.

With the foregoing and other advantages and features of the invention that will become hereinafter apparent, the nature of the invention may be more clearly understood by reference to the following detailed description of the invention, the appended claims and the views illustrated in the drawings.

DETAILED DESCRIPTION OF THE INVENTION

Figure 1:
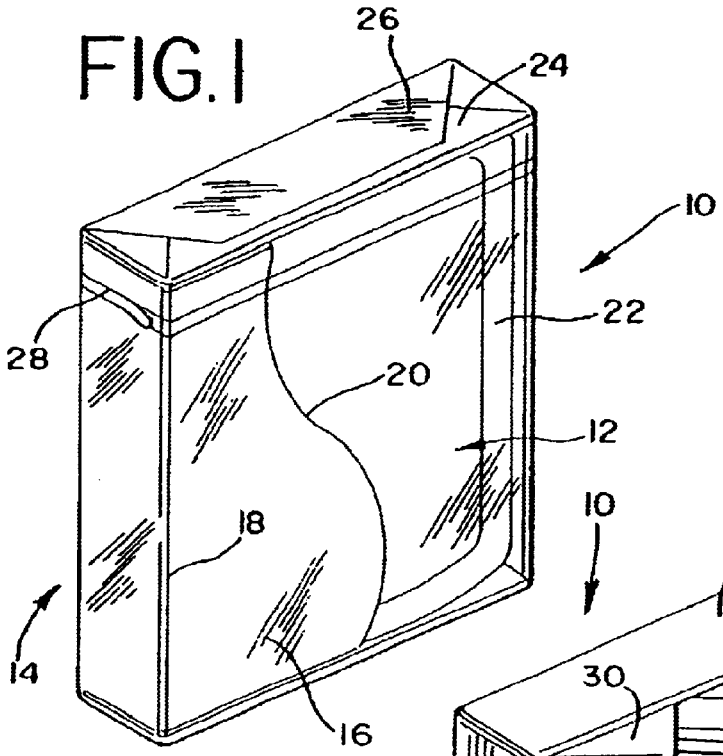
FIG. 1 is a perspective view of one embodiment of a cigarette box package made according to the invention with a sealed metal cigarette box enclosed in a paperboard box and overwrapped with a polymeric film.

Referring now in detail to the drawings, an embodiment of the invention shown in FIGS. 1–7 comprises a smoking article or filter cigarette package designated generally by reference numeral 10. In the embodiment shown in FIG. 1, package 10 has a rectangular parallelepiped shape and contains a metal cigarette box 12 described in more detail hereinafter. Package 10 comprises a paperboard box 14 folded from a paperboard blank (not shown) into a parallelepiped shape. The box 14 is provided with a front panel or lid 16 hinged along folded corner 18 of the box 14. Front panel 16 only partially covers the front opening of the box so as to leave exposed a portion of the metal cigarette box 12.

The free edge 20 of the lid 16 is generally S-shaped as shown, it being understood that edge 20 may have other shapes, both linear and non-linear. For instance, the edge 20 may be a straight linear edge oriented at an angle with respect to hinged comer 18, it may have a V-shape, or it may have an rounded, generally D-shape. Preferably, however, the shape of the edge 20 provides the paperboard box with a product differentiation or recognition feature. For example, the illustrated S-shaped edge of the paperboard box makes the package 10 of the invention especially suited for packaging the Salem® brand of menthol cigarettes manufactured by the assignee of the present invention. Other shapes of the front panel 16 that provide product differentiation or recognition features will be apparent to those skilled in the art.

The front panel 16 of the box 14 is also typically provided with printed product information or indicia, such as a logo or other trademark, and the other panels of the box 14 may also have printed indicia thereon, such as product information.

The box 14 is overwrapped with an overwrap film 22 which is preferably a transparent polymeric film, such as polypropylene, but which may be a metallized polymeric film. The film 22 is folded over at the top and bottom (not shown) of the package 10 and the flaps 24,26 are heat sealed in a conventional manner. If the film 22 is a metallized polymeric film, the printed indicia on the paperboard box 14 is preferably printed on the film 22 instead of, or in addition to, being printed on the panels of the box. A tear tape 28 is provided on the overwrap film 22 for use in removing the overwrap film from the paperboard, thereby permitting it to be opened by the consumer.

Figure 2:
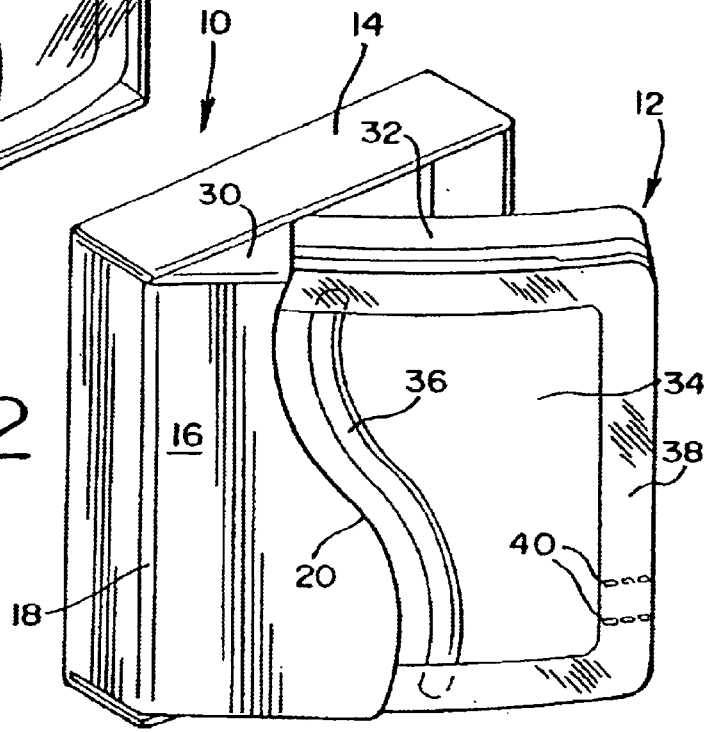
FIG. 2 is a perspective view of the package of FIG. 1 showing the overwrap removed and the hinged partial lid of the paperboard box open for removal of the metal cigarette box sealed with a shrinkable band.

FIG. 2 illustrates the package 10 with the overwrap 22 and tear tape 28 removed and the front panel 16 swung away from the box 14 to permit the metal cigarette box 12 to be removed from the paperboard box 14. As shown in FIG. 2, the front panel 16 is provided with side tabs 30 (only one shown) folded inwardly so as to slide along the inside of the top and bottom panels of the box 14 and provide additional support for the panel 16.

The metal cigarette box 12 comprises a five-sided metal tray portion 32 and a slidable metal lid portion 34 covering the front open side of the tray portion 12 as described in more detail in connection with FIGS. 3–7. The lid portion 34 is preferably embossed for purposes of stiffness and/or product differentiation or product origin information. In the illustrated embodiment, the lid 34 is embossed with a generally S-shaped ridge or bead 36 that corresponds to the S-shaped edge 20 of the paperboard front panel 16 so as to provide product differentiation or product origin information even after the paperboard box is removed and discarded. Other portions of the lid 34 may also be embossed if desired.

A band 38 of shrinkable polymeric material, preferably a heat-shrinkable polymer, is shrunk about the perimeter of the metal cigarette box 12 to seal the lid 34 to the tray 32 in a tamperproof manner. Perforations 40 are provided transversely of the band so as to permit the band to be torn away from the box 12 and allow the consumer to access to the cigarettes contained in the box.

Figure 3:
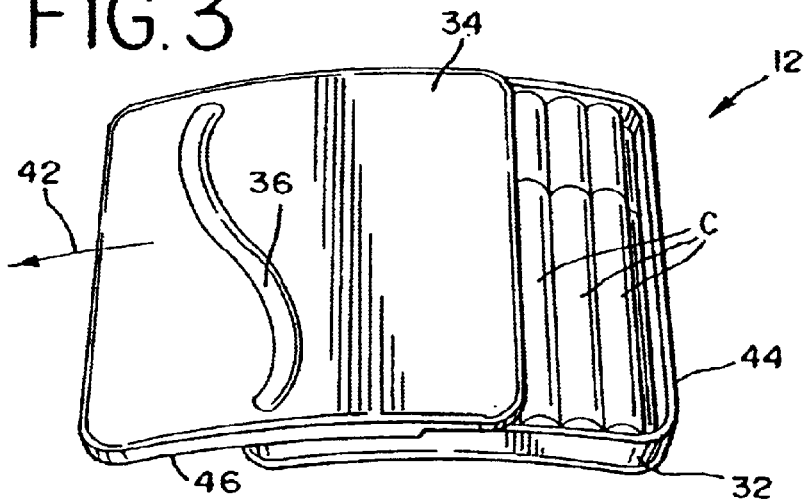
FIG. 3 is a perspective view of the metal cigarette box of FIG. 2 showing the shrinkable band removed from the metal box and the slidable lid of the metal box opened to expose the cigarettes contained therein.
Figure 4:
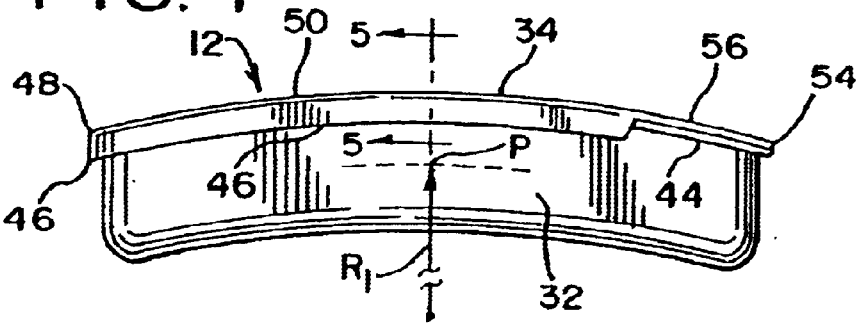
FIG. 4 is a side elevation view of the metal cigarette box of the invention with the metal lid closing the box and the shrinkable band removed.

Referring now to FIGS. 3–7, the metal cigarette box 12 of the present invention will be described. As shown in FIGS. 3 and 4, the tray 32 and lid 34 have a curved and rounded shape. The radius of curvature $R_1$ of the midpoint P between the lid 34 and the bottom of the tray 32 is in the range of about 100 to 800 millimeters, preferably 200 millimeters. The designed curvature corresponds generally to the curvature of the torso of the human body so that the box will fit comfortably in, and generally conform to, the body when the box is placed, for example, in a shirt or pant pocket. The rounded corners and edges of the box are also designed to provide a more comfortable "feel" for the consumer as well as an attractive package.

Figure 6:
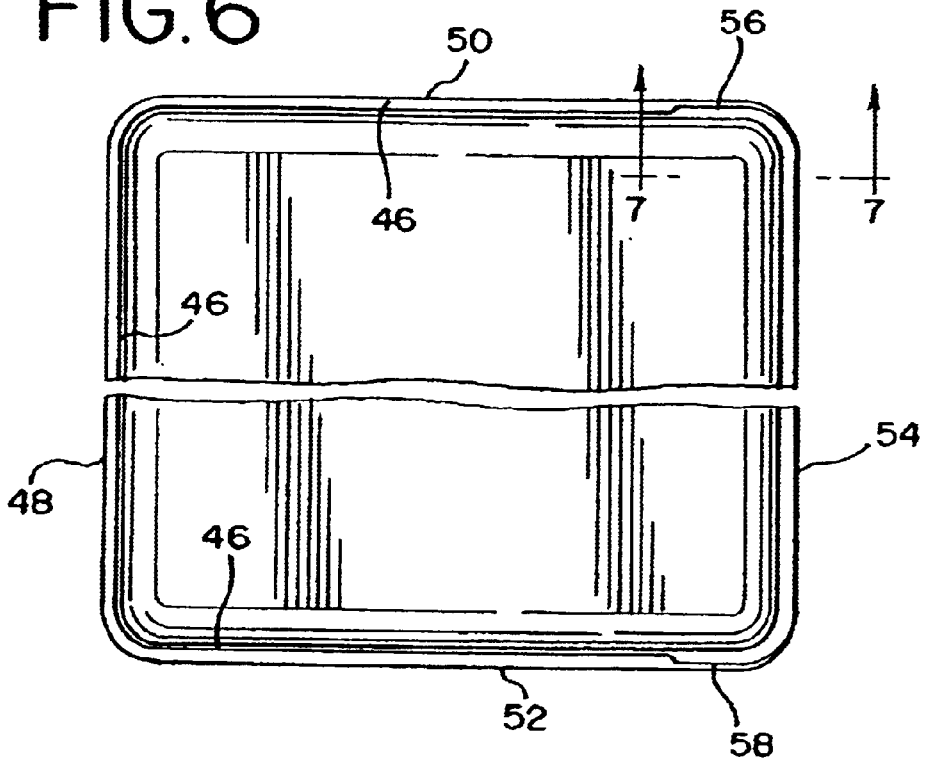
FIG. 6 is a plan view of the metal lid for the metal cigarette box of the invention as viewed from the underside or from the inside of the box.
Figure 5:
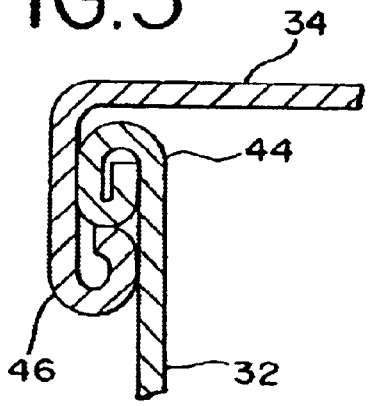
FIG. 5 is a cross-sectional detail taken along line 5–5 of FIG. 4 showing the structure of the mechanical sliding engagement between the rolled edges of the metal lid and the metal box of the invention.
Figure 7:
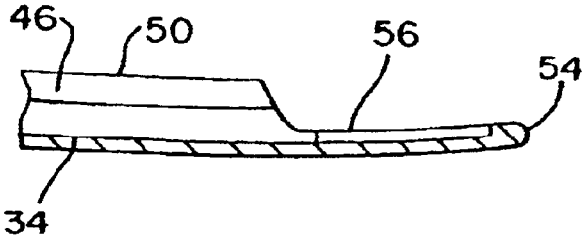
FIG. 7 is a cross-sectional detail taken along line 7–7 of FIG. 6 showing the transition between the flattened edge of the metal lid and the rolled edge of the metal lid.

The lid 34 is slidable in one direction, i.e., to the left as shown by the arrow 42 in FIG. 3, to open the box 12 and permit consumer access to the cigarettes C in the tray portion 32. After a cigarette C is removed from the tray portion 32, the lid 34 is slid in the direction opposite the arrow 42 to reclose the box 12. The lid 34 is mechanically and slidably retained on the tray portion 32 by interengaging rolled edges or lips 44, 46 on the tray portion 32 and the lid portion 34, respectively (FIG. 5). The rolled lip 44 of the tray portion 32 is formed around the entire perimeter of the tray portion 32, whereas the rolled lip 46 of the lid portion 34 is formed along the entire edge 48 and a substantial portion of the edges 50, 52 of the lid portion (FIG. 6). The edge 54 of the lid portion 34 and short sections 56, 58 of the edges 50, 52 are rolled over and flattened as best shown in FIGS. 4 and 7 to permit the lid to be slid back-and-forth over the open front of the tray 32. As will be apparent, the lid 34 cannot be slid to the right (as viewed in FIG. 3) to open the box since the rolled lip 46 along edge 48 of the lid acts as a positive stop or abutment when the lid 34 is moved in a direction to close the box 12.

Preferably, there is metal-to-metal engagement between the rolled lips 44, 46 along the edges 48, 50, 52 of the lid and between the rolled lip 44 of the tray 32 and the flattened edges 54, 56, 58 of the lid 34. Such metal-to-metal engagement between the lid and tray portions 32, 34 helps to preserve the freshness and aroma of the cigarettes C contained in the metal cigarette box 12. To the extent the rolled lips and flattened edges of the lid 34 do not engage completely in metal-to-metal sealing contact with the rolled lip 44 of the tray 32, the shrinkable band 38 provides an additional force that urges those lips and edges into sealing, metal-to-metal contact until the band 38 is removed from the box 12.

The metal from which the cigarette box 12 is formed is preferably a metal or metal alloy, such as 1018 steel alloy, having a thickness in the range of 0.005 inch to 0.015 inch. Other metals or metal alloys, such as 3003 aluminum alloy, may also be used to manufacture the box 12. Conventional metal working processes apparent to those skilled in the metal working art may be used to form the curved tray and lid and to roll and flatten the edges of the tray and lid. The tray preferably contains 20 cigarettes in a 2 by 10 arrangement.

While the box 12 of the present invention is preferably made of a thin sheet metal, it would be possible to mold the box of a polymeric material, e.g., an injection molded high density polyethylene, polycarbonate, or other suitable moldable plastic material. In such case, the interengaging lips between the tray and lid portions may be molded to sealingly engage in a manner similar to the engagement of rolled lips and edges of the metal tray and lid.

In addition to providing a unique package for smoking articles, it will be appreciated that the cigarette package of the invention may be used to package products other than cigarettes and that the metal cigarette box may be used after the cigarettes contained therein are consumed to contain other articles, such as, for example, jewelry, coins, paper clips, etc.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A package for containing articles comprising:

a curved metal box having a tray portion with an open front and a lid portion slidable back-and-forth over the open front of the tray to open and close the tray portion, the tray portion having a curved back surface with a concave exterior and the lid portion having a curved front surface with a convex exterior, the tray and lid portions being formed of a thin sheet metal and at least one of the tray portion or the lid portion having an outwardly extending lip and the other of the tray portion or the lid portion having an inwardly extending lip, said lips slidably engaging one another to allow the lid portion to slide back and forth over the open front of the tray portion, a band shrunk around said tray and lid portions of the metal box in tamperproof relation over the front of the tray portion, said band having perforations therein for tearing the band and removing it from the metal box, a folded paperboard box in the shape of a rectangular parallelepiped containing said metal box, wherein said paperboard box has an open front with a front panel hinged to the paperboard box along a fold line, said front panel covering only a portion of the open front of the paperboard box, and a polymeric overwrap film overwrapping the paperboard box.

2. The package of claim 1, wherein said articles are cigarettes.

3. The package of claim 1, wherein said lid portion has product differentiation indicia embossed therein.

4. The package of claim 1, wherein said tray and lid portions each have a four-sided perimeter, said outwardly and inwardly extending lips comprising an outwardly rolled lip around the entire perimeter of the open front of the tray portion and an inwardly rolled lip on only three of the four sides of the perimeter of the lid portion.

5. The package of claim 4, wherein one side of the perimeter of the lid portion and portions of the two sides of the perimeter of the lid portion adjacent said one side have rolled flattened edges.

6. The package of claim 5, wherein the outwardly rolled lips and flattened edges of the tray and lid portions engage in sealing, metal-to-metal contact.

7. The package of claim 1, wherein said overwrap film is a transparent polymeric film, said paperboard box having product indicia applied thereto.

8. The package of claim 1, wherein said front panel has a free edge shaped to provide product differentiation or product origin information.

9. The package of claim 1, where said thin sheet of metal is a steel or aluminum alloy having a thickness between about 0.005 inch and 0.015 inch.

10. The package of claim 1, wherein the radius of curvature of the midpoint between the tray and lid portions is about 200 millimeters.

11. A cigarette package comprising:

a curved metal box having a tray portion with an open front and a lid portion slidable back-and-forth over the open front of the tray to open and close the tray portion, the tray and lid portions having, respectfully, a concave and a convex exterior surface, the tray and lid portions being formed of a thin sheet metal and having interengaging lips for slidable engaging the lid portion with the tray portion, a band shrunk around the tray and lid portions of the curved metal box to retain the lid portion in closed, tamperproof relation over the front of the tray portion; and a paperboard box having a rectangular parallelepiped shape containing said curved metal box, said paperboard box having an open front and a front panel covering a portion of the open front of the paperboard box, and a polymeric overwrap film overwrapping the paperboard box.

12. The cigarette package of claim 11, including a tear tape disposed about said overwrap film for removing the overwrap film from the paperboard box, and wherein said band includes perforations therein for tearing the band and removing it from the curved metal box.

13. The cigarette package of claim 11, wherein said front panel has a free edge shaped to provide product differentiation or product origin information.

14. A cigarette package comprising:

a curved box having a tray portion with an open front and a lid portion slidable back-and-forth over the open front of the tray to open and close the tray portion, the tray and lid portions having, respectfully, a concave and a convex exterior surface, each said surface having a radius of curvature between about 100 and 800 millimeters, the tray and lid portions having interengaging lips for slidably engaging the lid portion with the tray portion, a band shrunk around the tray and lid portions of the curved box to retain the lid portion in sealed relation over the front of the tray portions, said band having perforation therein for tearing and removing it from the curved box;

a paperboard box having a rectangular parallelepiped shape containing said curved box, said paperboard box having an open front and a front panel covering a portion of the open front of the paperboard box, said front panel having a free edge shaped to provide product differentiation or product origin information; and a polymeric overwrap film overwrapping the paperboard box and a tear tape disposed about said overwrap film for removing the overwrap film from the paperboard box.

15. A package for containing articles comprising:

a curved metal box having a tray portion with an open front and a lid portion slidable back-and-forth over the open front of the tray to open and close the tray portion, the tray portion having a curved back surface with a concave exterior and the lid portion having a curved front surface with a convex exterior, the tray and lid portions being formed of a thin sheet metal and at least one of the tray portion or the lid portion having an outwardly extending lip and the other of the tray portion or the lid portion having an inwardly extending lip, said lips slidably engaging one another to allow the lid portion to slide back and forth over the open front of the tray portion, a band shrunk around said tray and lid portions of the metal box in tamperproof relation over the front of the tray portion, said band having perforations therein for tearing the band and removing it from the metal box, a folded paperboard box in the shape of a rectangular parallelepiped containing said metal box, wherein said paperboard box has an open front with a front panel hinged to the paperboard box along a fold line, said front panel having a free edge shaped to provide product differentiation or product origin information, and a polymeric overwrap film overwrapping the paperboard box.

16. The package of claim 15, wherein said articles are cigarettes.

17. The package of claim 15, wherein said lid portion has product differentiation indicia embossed therein.

18. The package of claim 15, wherein said tray and lid portions. each have a four-sided perimeter, said outwardly and inwardly extending lips comprising an outwardly rolled lip around the entire perimeter of the open front of the tray portion and an inwardly rolled lip on only three of the four sides of the perimeter of the lid portion.

19. The package of claim 18, wherein one side of the perimeter of hie lid portion and portions of the two sides of the perimeter of the lid portion adjacent said one side have rolled flattened edges.

20. The package of claim wherein 19, the outwardly rolled lips and flattened edges of the tray and lid portions engage in sealing, metal-to-metal contact.

21. The package of claim 15, wherein said overwrap film is a transparent polymeric film, said paperboard box having product indicia applied thereto.

22. The package of claim 15, where said thin sheet of metal is a steel or aluminum alloy having a thickness between about 0.005 inch and 0.015 inch.

23. The package of claim 15, wherein a radius of curvature of the midpoint between the tray and lid portions is between about 100 and about 800 millimeters.

24. The package of claim 15, wherein said front panel covers only portion of the open front of the paperboard box.

* * * * *